United States Patent [19]

Harrild

[11] 4,453,646

[45] Jun. 12, 1984

[54] CLOSURE HAVING FRANGIBLE MEANS

[75] Inventor: Niels Aage L. Harrild, Söborg, Denmark

[73] Assignee: Nigu-Pack A/S, Söborg, Denmark

[21] Appl. No.: 413,348

[22] PCT Filed: Dec. 21, 1981

[86] PCT No.: PCT/DK81/00117

§ 371 Date: Aug. 23, 1982

§ 102(e) Date: Aug. 23, 1982

[87] PCT Pub. No.: WO82/02183

PCT Pub. Date: Jul. 8, 1982

[30] Foreign Application Priority Data

Dec. 23, 1980 [DK] Denmark ..... 5491/80

[51] Int. Cl.[3] ..... B65D 51/22

[52] U.S. Cl. ..... 220/258; 220/270; 220/306; 220/307

[58] Field of Search ..... 220/258, 270, 273, 276, 220/306, 307

[56] References Cited

U.S. PATENT DOCUMENTS 3,300,081 1/1967 Muhlhoff ..... 220/270

3,434,620 3/1969 Lavrizio ..... 220/270

*Primary Examiner*—George T. Hall

*Attorney, Agent, or Firm*—Antonelli, Terry & Wands

[57] ABSTRACT

A sales jug of thermoplastic material has a sealing lid (14) which is secured by a very firm snap locking engagement with a groove (6) in the edge portion of the jug, while the lid (14) is adapted to be opened by means of a rupture arrangement inside the snap locked edge portion (18) thereof. For stabilizing the locking engagement the lid is provided with an upstanding edge flange (24), which is rested laterally against a corresponding upper and outer annular flange portion (8) of the jug. The upstanding edge flange (24) of the lid is extended outwardly and downwardly about the top edge of the said annular flange (8) of the jug, whereby this flange (8) is stabilized against a release of the snap lock arrangement. The outermost portion (28) of the extended lid edge flange (24) serves to hold a skirt portion of a reclosing lid (42). The sealing lid (14) together with the reclosing lid (42) may be mounted automatically on the jug by means of a high pressing force whereby a firm snap locking is achievable even with a relatively short locking displacement of the sealing lid (14), and when this displacement is short, the liquid filled jug may be closed and sealed practically without any air remaining trapped therein.

12 Claims, 8 Drawing Figures

Figure 1:
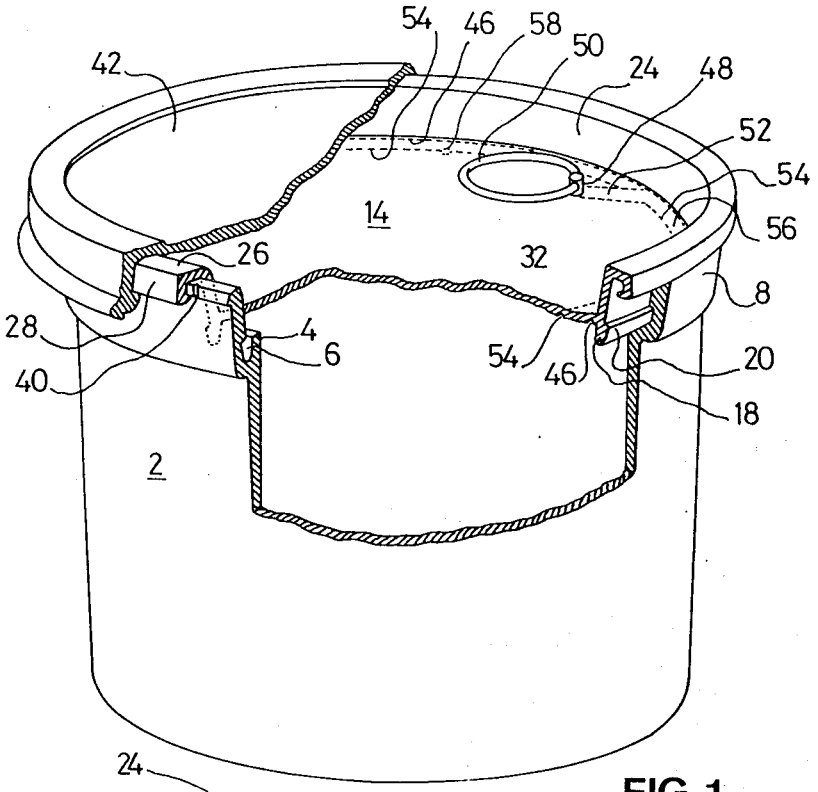

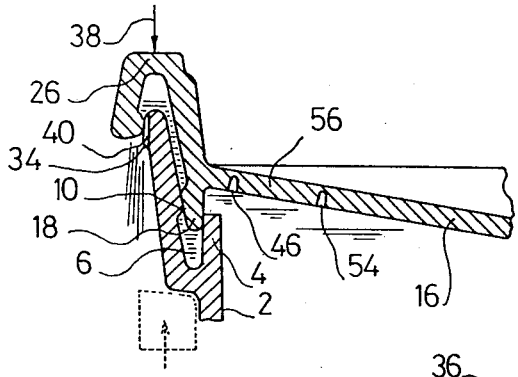
FIG. 4
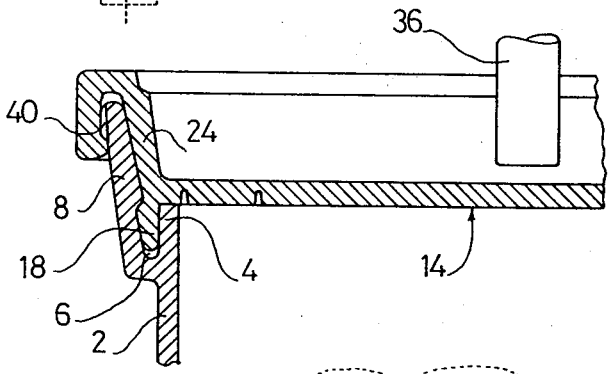
FIG. 5
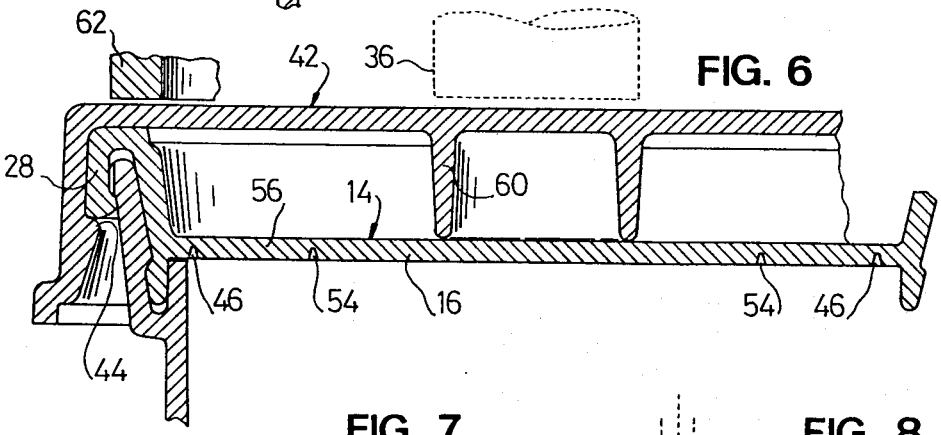
FIG. 6
FIG. 7
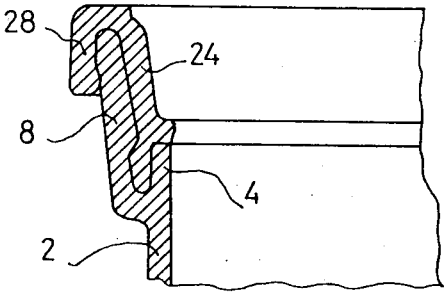
FIG. 8
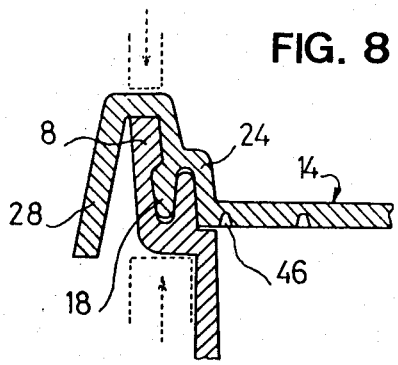

CLOSURE HAVING FRANGIBLE MEANS

The present invention relates to a jug shaped container of thermoplastic material, as used as a sales packing e.g. for paint or for foodstuff products in a dressing, the container having a lid of substantial diameter and secured to the container by snap lock action between complementary holding means along the edge of the lid and the top edge of the container, respectively. With the conventional jug designs the holding effect on the lid shall have to be a compromize between a safe closure which is resistant against an internal overpressure as caused e.g. by impacts during shipping and handling and a closure which is reasonably easy to open, and generally, in practice, it is the closing safety which is hereby compromized. An internal overpressure does not necessarily cause the lid to be forced off the jug, but a leakage may occur at one or more places along the edge.

The container according to the invention is based on the idea that the lid is caused to be held with such a firm locking that it will resist a considerable internal overpressure in a fully sealed manner, while an easy opening of the lid is secured by a tear up arrangement preferably based on weakened rupture lines in the lid inside the edge portion thereof. In a preferred embodiment of the invention the tear up arrangement includes the entire lid portion inside a narrow rim as locked to the top edge of the jug, such that the jug is opened to the full internal mouth diameter thereof, with the said rim portion of the lid being left permanently on the jug edge apparently as a fully integral part thereof. When the rim portion is thus left as a part simply constituting the uppermost portion of the side wall of the open jug, then the interacting snap locking means may be designed solely from an efficiency point of view or rather from any point of view but the appearance of the interacting surfaces themselves, since these will remain hidden and without functional or other importance in the opened jug.

It may be desirable to reclose the jug in a less firmly sealed manner upon the first opening thereof, and to this end the closed jug may be provided with a separate top lid which is fairly easy to remove from the jug and to replace on the opened jug. According to the invention it is of special advantage if the reclosing lid is mounted in holding engagement with the said rim portion of the first mentioned sealing lid, because the two lids may then in an industrial jug filling and closing station be applied to the jug as a single preassembled unit.

When the sealing lid itself shall not be adapted so as to be manually remountable on the jug it will be practically possible to design the interacting snap locking means of the lid and the jug in such a manner that the mounting of the sealing lid shall require a pressing force higher than normally expectable by a manual closing; such an increased pressing force is readily available in connection with the use of automatic handling equipment in the industrial filling and closing plant, and an important consequence is that a very firm and highly sealed snap lock engagement is achievable by means of a snap lock arrangement which requires a very short mutual locking movement between the lid and the jug. The shortness of this relative movement, as explained in more detail below, will involve a possibility of closing a liquid filled jug with only a neglectible amount of air remaining therein, this being of importance for many kinds of products to be sold in jugs of the type in question.

As will also be explained in more detail below, the said possibility of shaping the interacting snap locking means without any special attention to the appearance of the locking means individually will equally account for advantages with respect to the achievement of a closure which is resistant against an excessive internal overpressure in the closed jug, because respective portions of the rim of the lid and the top edge of the jug may be designed to support each other for counteracting a cross sectional tilting and loosening of the snap locking means in response to a deformation of the lid as caused by the said over-pressure.

It is of major importance that the rim of the lid is held by a local cross sectional snap locking engagement with the top edge of the jug, preferably by virtue of a depending cylindrical locking flange portion of the lid being received in an upwardly open edge groove of the jug. A similar, though inverted arrangement is known from certain bottle closures, but generally the problems of closing bottles are not fully comparable to the closing of a wide jug mouth, since a narrow bottle mouth may be effectively closed with a cap member engaging the outside of the bottle neck, whereby the sealing is a function of the cap being diametrically and circumferentially stretched. A local flange and groove connection is more effective, because a firm locking clamping of the flange portion between the groove sides may be obtained regardless of usual diameter tolerances.

The use of a depending locking flange on the lid edge may present problems as to the closing of an entirely liquid filled jug without trapping an amount of air under the closed lid. As described below, however, it is possible to design or handle the lid so as to reduce the trapped air to a neglectible minimum without any need of arranging for special venting means in the lid.

In a preferred jug according to the invention the jug container is shaped with an exterior upstanding flange portion forming the outer side of the edge groove and projecting to a level above the internal mouth portion of the jug, while the lid has a correspondingly upstanding flange portion which engages the inner side of the exterior flange so as to remain joined therewith once the jug has been closed. There are two important advantages obtained hereby, viz. that a flat cup shaped space is created above the lid portion to be torn off, whereby liquid escaping upwardly during the tear off of the lid will not overflow the top edge of the jug, and that the depending snap lock flange of the lid will be stabilized against loosening edging or tilting movements in the groove as caused e.g. by vertical forces acting on the central area of the lid, because the said upstanding flanges will generally stabilize the cross sectional configuration of the entire edge assembly.

The upstanding edge flange of the lid may advantageously be extended outwardly over the top edge of the corresponding exterior flange of the jug and downwardly along the outside thereof. Hereby the extended flange will serve to hold the jug flange against outward tilting movement thereof, and this will contribute to counteract any loosening edging effect on the depending snap lock flange. Moreover the extended top portion of the lid flange will constitute a highly suitable portion for holding the said reclosing lid.

Figure 2:
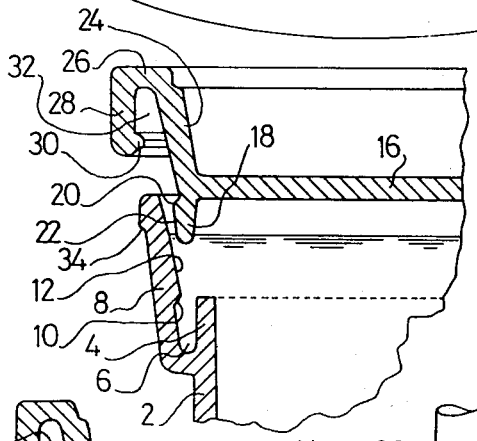
Figure 3:
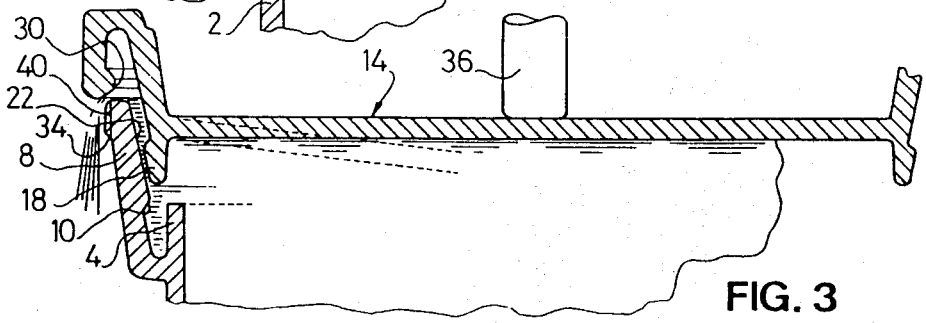

In the following the invention is described in more detail with reference to the drawing, in which:

FIG. 1 is a perspective view of a jug according to the invention, shown partly in section, FIG. 2 is a sectional view of a top edge portion of the jug with the sealing lid ready to be mounted thereon, FIGS. 3 and 4 are corresponding views seen during the mounting of the lid, FIG. 5 is a corresponding view of the jug as finally closed, FIG. 6 is a similar view of the jug as provided with a reclosing lid, FIG. 7 is a similar view of the jug with the sealing lid removed, and FIG. 8 is a view corresponding to FIG. 5 and showing a modified jug and sealing lid assembly.

The jug shown in FIGS. 1–6 comprises a jug body 2 made by injection moulding of an ordinary thermoplastic material. The interior cylindrical top wall portion of the jug body is designated 4, and from an exterior annular area of this wall portion slightly below the top edge thereof projects an exterior flange portion 8 outwardly and then upwardly to a level well above the top of the inner wall portion 4, such that between the wall or flange portions 4 and 8 there is formed an annular edge groove 6. Approximately in level with the top edge of the wall 4 the interior side of the outer flange 8 has an undercut locking nose 10, above which the inner side 12 of the upstanding outer flange 8 projects upwardly and slightly outwardly inclined.

An associated sealing lid is generally designated 14 and comprises a horizontal lid plate portion 16 having along its periphery a downwardly projecting locking flange 18 showing an exterior locking nose 20 and an outer surface portion 22 below the nose 20 which is inclined or conical corresponding to the conicity of the jug flange surface portion 12. The lid furthermore has an upstanding annular flange 24, which is topwise extended outwardly in a portion 26 and then downwardly in an outer cylindrical flange portion 28, which is adjacent its lower edge provided with an inwardly projecting nose portion 30, above which there is a groove space 32 defined between the flange portions 24 and 32.

This groove 32 is adapted to receive the top end of the outer jug flange 8, and for cooperation with the said nose portion 30 the outside of the flange 8 is provided with an exterior nose or undercut portion 34.

As shown in FIGS. 1 and 6 the assembly may comprise an additional reclosing lid 46 to be described in more detail below. For the mounting of the sealing lid 14 it is less important whether or not the reclosing lid 46 is present.

In FIG. 2 it is indicated that the jug member 2 is initially liquid filled to a level above the top edge of the internal mouth portion 4, and the sealing lid 14 is placed so as to be mountable on the jug by a relative downward movement of the lid. As shown in FIG. 3 the lid may be forced downwardly by means of a central pressing shoe 36, whereby the lid is easily brought into a position in which the outside of the depending lid flange 18 engages the inner side 12 of the exterior jug flange 8 above the nose portion 10 thereof. Once this engagement has been established the liquid in the jug 2 will no longer escape readily by the downward movement of the lid 14, but it will escape anyway because the central downpressing of the lid 14 causes the lid plate 16 to be deformed conically so as to reduce its diameter, while at the same time an increased internal pressure in the jug will be able to force the exterior jug flange 8 slightly outwardly.

Hereby the liquid may still escape at least until the lid 14 reaches the relative position shown in FIG. 4, wherein the depending locking flange 18 of the lid 14 is initially entering the edge groove 6 of the jug. At the same time or slightly earlier the outer top side of the flange 8 is engaged by the locking nose 30, whereby the flange 28 is forced somewhat outwardly and the top end of the flange 8 is forced or held inwardly. To facilitate the escape of the liquid the locking nose 30 or—as shown—the outside of the flange 8 above its nose 34 may be provided with vertical grooves 40.

When the locking flange 18 has reached the position shown in FIG. 4 the continued downward movement of the central pressing shoe 36 will result in a conical deformation of the lid, as also shown in FIG. 4. By this deformation a further volume of air and liquid as present underneath the lid will be brought to escape, and only a small volume of air will remain thereafter, along the edge area of the lid.

Thereafter a final closing force is applied to the top portion 26 of the lid edge, as shown by an arrow 38 in FIG. 4, and at the same time the pressure as exerted by the central pressing shoe 36 is relieved.

The final closing force 38 is applied by a circular piston (not shown), and because a relatively high force can be mechanically applied, without moderation for enabling a later manual reclosing, the interacting locking portions may be designed such that they establish a very firm locking engagement by a relatively short relative displacement of the lid. By this short movement (from FIG. 4 to FIG. 5) the nose 20 of the lid will engage under the nose portion 10 of the flange 8, and the surplus of liquid in the groove 6 will be forced to find its way out. The general volume reduction of the jug space during the final closing movement is compensated for by the central portion of the lid now being able to move upwardly, at least relative the lid edge. As a result the jug may be closed so as to be practically entirely liquid filled and with the lid 14 having a usual planar appearance.

During shipping and handling of the closed jug the locking engagement especially between the noses 10 and 20 will remain very firm. Should the lid be forced upwardly by an internal overpressure caused by an impact, then the lower interior wall of the groove 6 as well as the upstanding flanges 8 and 24 will stabilize the depending locking flange 18 against edging in the groove 6. Even the location of the active nose 20 of the lid just outside the edge of the planar lid portion has a stabilizing effect.

In the locked position of the lid the underside of the planar lid portion abuts edgewise the top end of the interior mouth portion 4 of the jug.

As shown in FIGS. 1 and 6 the closed jug may be provided with a reusable top lid member 42, which is held with a nose portion 44 snapping underneath the lower edge of the exterior flange 28 of the sealing lid 14. This reclosing lid 46 is designed so as to be manually removable and remountable.

The sealing lid 14 is openable by being rupturable along an annular weakening groove 46 which is located such that in the closed position of the lid it follows the inner edge of the interior mouth cylinder portion 4 of the jug. The lid is integrally provided with a short upstanding pin portion 48, see FIG. 1, which is itself integrally provided with a horizontal ring member 50 to be manually lifted for tearing off the lid along the weakening groove. In practice, however, the groove 46 should not weaken the lid plate to the extent that already a pull in the ring 50 would be sufficient to rupture the lid, and in a preferred arrangement, therefore, the pin 48 is located endwise of a strip portion 52 confined between two parallel lines constituted by respective grooves in the underside of the lid, one of these grooves maturing in the annular groove 46 while the other groove continues in an annular groove 54 located inwardly spaced from the groove 46 such that a circular material strip 56 is defined between these grooves.

When the ring 50 is lifted the pin 48 will be caused to tilt and this initially break the weakened lid material at the end of the strip portion 52, whereafter by further pulling in the ring 50 the strip portion 52 and thereafter the annular strip portion 56 will be torn up. This continues almost all the way round, until the inner groove 54 stops or has a local outfilling at 58, whereby a further pull in the ring and the already torn up strip portion 52,56 will result in a further rupture along the exterior groove 46 only, i.e. now the major lid portion itself will be torn off along the remaining part of the exterior groove 46 until the lid is completely opened and removable when the former point of junction with the initial portion 52 is reached.

It will be appreciated that the jug as thus opened will show a practically smooth interior mouth wall, as illustrated in FIG. 7, and the entire edge portion of the opened jug will appear as unitary.

It will also be appreciated that during the opening of the sealing lid (irrespectively of how the lid is opened, e.g. even by cutting ) any upwardly leaking liquid from the jug will not overflow the top edge of the jug assembly, as it will be held back by the upstanding edge flange 24 and thus be returned to the jug when the central lid portion is removed.

In FIG. 6 it is shown that the reclosing lid 42 may have a centrally depending, annular flange 60 which steps on the top side of the sealing lid 14, whereby the central closing pressure on the lid 14 by means of the pressing shoe 36 (FIG. 3) may be exerted on the top side of the reclosing lid 42. Since the reclosing lid 42 is carried entirely by the sealing lid these two lids may be mounted as a preassembled unit, this being an important advantage in the filling and closing station. Even edgewise the reclosing lid 42 is resting on the sealing lid 14, viz. on the upper flange portion 26 thereof, whereby the final closing force 38 (FIG. 4) may be applied by means of an annular piston 62 (FIG. 6) pressing on the top side of the reclosing lid 42.

The possible preassembly of the two lids 14 and 42 has the further advantage that by their positive holding engagement they stabilize each other should one of them happen to be crooked. This may be particularly relevant to the lid 14 because of its non-symmetrical design with respect to the weakening groove 54, which conditions a non-uniform outflow resistance of the moulding material in the injection mould, in which the lid is produced, because the groove 54 (or its corresponding mould part) is not extending fully continuously all the way along the edge of the lid.

FIG. 8 shows an embodiment in which the locking flange 18 of the sealing lid is depending not from the edge of the central lid portion, but from the outside of the upstanding edge flange 24 of the lid, and the corresponding upstanding outer flange 8 of the jug is shaped in a complementary manner. In this embodiment the locking flange 18 does not depend below the level of the central lid portion, i.e. when the lid is lowered towards the open jug top the depending locking flange 18 will not act to collect an air cushion underneath the central portion of the lid, and the air volume collected or confined by the flange 18 of FIG. 8 will be absolutely negligible, also because the collected small volume of air between the flange 18 and the flange 24 will be "washed out" by the liquid as escaping from the jug during the final phase of the lid mounting operation.

In the embodiment of FIG. 8 there is no outermost locking nose connection between the upstanding jug flange 8 and the exterior lid flange 28, but the latter is still designed so as to support the exterior top edge of the flange 8 against any displacement outwardly, i.e. the flange 28 will contribute to the flange 8 being held in locking engagement with the lid flange 18 despite any expanding effect on the flange 8 or—likewise—any contracting effect on the flange 24 as caused e.g. by an impact on the sealed jug, whereby the sealing lid 14 tends to get deformed conically upwardly.

By any conical deformation of the central major portion of the sealing lid the upstanding lid flange 24 and the depending locking flange 18 will be cross sectionally influenced to carry out a tilting movement relative the edge portions of the jug, and such movement may result in a lid loosening crowbar action between the various flange portions. First of all, however, the design of the said cross section according to the invention will minimize the effective crowbar action of the interacting locking nose portions, but additionally the presence of the outermost weakening groove 46 will involve that the remaining lid material portion above the weakening groove will act as a bendable hinge portion, whereby the tilting force on the outer lid edge portions as produced by a conical deformation of the lid 14 will be drastically reduced.

The invention is in no way limited to the embodiments shown in the drawing, e.g. because the locking nose engagement between the jug and the sealing lid may be located adjacent the interior side of the locking flange 18, and the primary locking effect may even occur between nose portions of an upstanding flange of the jug and one or both sides of a downwardly open groove defined by flange portions of the sealing lid. With the use of a downwardly protruding locking flange 18 of the lid 14 this flange may be located at a still higher level than according to FIG. 8, e.g. for cooperation with a topwise arranged groove in the flange 8 of the jug.

The invention also comprises the described method whereby a sealing lid as combined or not combined with a reclosing lid is brought into a locked position on the top edge of a jug member. In order to ensure an efficient escape of a trapped air volume underneath the sealing lid it may be preferable to effect the lid mounting with the lid and the jug assuming a generally inclined position.

A well suited material for the jug and the sealing lid will be low pressure poly ethylene or propylene, which shows the required resiliency for the snap locking function and is otherwise suitably rigid for the general stability of the jug.

I claim:

1. A jug shaped container of a thermoplastic material, the container comprising a sealing lid means for sealing the jug shaped container, a snap action locking means provided between respective edge portions of the container and the sealing lid means, said snap action locking means being adapted to be actuated by a short locking displacement of the sealing lid means upon application of a high pressing force and being adapted to be substantially impossible to manually release, said sealing lid means being adapted to be opened interiorly of the jug edge portions whereby an outer edge portion of the lid means, upon opening thereof, forms an apparently integrally portion of the jug shaped container, a reclosing lid means including a snap lock means cooperating with at least one of an outer portion of the edge of the jug or an outer portion of the sealing lid means, whereby the sealing lid means and the reclosing lid means are mountable on the jug shaped container as a preassembled unit.

2. A container according to claim 1, wherein the snap action locking means provided between the edge portions of the container and the sealing lid means includes an upstanding edge flange and a depending lock flange, the jug shaped container is provided with an upwardly open locking groove for receiving the locking flange and an exterior upstanding annular flange for laterally supporting the upstanding flange of the sealing lid means.

3. A jug shaped container of a thermoplastic material, the container comprising a sealing lid means for sealing the jug shaped container, snap action locking means provided between respective edge portions of the container and the sealing lid means, said snap action locking means being adapted to be actuated by a short locking displacement of the sealing lid means upon application of a high pressing force and being adapted to be substantially impossible to manually release, said sealing lid means being adapted to be opened internally of the jug edge portions whereby an outer edge portion of the lid means, upon an opening thereof, forms an apparently integral portion of the jug container, the snap action locking means provided between the edge portions of the container and the sealing lid means includes an upstanding edge flange and a depending locking flange, the jug shaped container is provided with an upwardly open locking groove for receiving the locking flange and an exterior upstanding annular flange for laterally supporting the upstanding flange of the sealing lid means, a top side of the upstanding edge flange of the sealing lid means extends outwardly and downwardly about the top edge of said annular flange of the jug shaped container.

4. A container according to claim 3, further comprising additional snap locking means between the outside of said annular flange of the jug shaped container and an inside of the downwardly projecting outer portion of the extended flange of the sealing lid means.

5. A container according to claim 2, wherein the depending locking flange has a locking nose portion located close to an edge portion of the sealing lid means from which the locking flange depends, such that the locking flange tapers downwardly substantially along an entire height thereof.

6. A container according to claim 2, wherein the sealing lid means is adapted to be stepped over the top edge of the interior mouth wall portion of the jug shaped container.

7. A container according to claim 6, wherein the sealing lid means is provided with an annular weakening groove means for facilitating a rupture opening of a central part of the sealing lid means, said weakening groove means being located immediately adjacent an inner top edge of said mouth wall portion of the jug shaped container.

8. A container according to claim 1, wherein a vertical spacer means is substantially centrally disposed between an underside of the reclosing lid means and a topside of the sealing lid means.

9. A container according to one of claims 2 or 5, wherein the depending locking flange depends from an outside of the upstanding edge flange of the sealing lid means and projects downwardly to a level above or not substantially below a level of the underside of a central substantially planar portion of the sealing lid means.

10. A container according to claim 8, wherein said vertical spacer means is formed as an annular flange projecting downwardly from the reclosing lid means.

11. A container according to claim 3, wherein a reclosing lid means is provided which includes a snap locking means for cooperating with at least one of an outer periphery of the edge of the jug shaped container or an outer portion of the sealing lid means, whereby the sealing lid means and the reclosing lid means are mountable on the jug shaped container as a preassembled unit.

12. A container according to claim 11, further comprising an additional snap locking means between the outside of the annular flange of the jug shaped container and an inside of the downwardly projecting outer portion of the extended flange of the sealing lid means.

* * * * *